US011608735B2

(12) United States Patent
Wisinger, Jr.

(10) Patent No.: US 11,608,735 B2
(45) Date of Patent: Mar. 21, 2023

(54) DRILL BIT POSITION MEASUREMENT

(71) Applicant: Halliburton Energy Services, Inc., Houston, TX (US)

(72) Inventor: John Leslie Wisinger, Jr., Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/969,862

(22) PCT Filed: Apr. 27, 2018

(86) PCT No.: PCT/US2018/029690
§ 371 (c)(1),
(2) Date: Aug. 13, 2020

(87) PCT Pub. No.: WO2019/209307
PCT Pub. Date: Oct. 31, 2019

(65) Prior Publication Data

US 2021/0396128 A1 Dec. 23, 2021

(51) Int. Cl.
*E21B 47/092* (2012.01)
*E21B 44/00* (2006.01)
*E21B 47/024* (2006.01)

(52) U.S. Cl.
CPC ..... *E21B 47/092* (2020.05); *E21B 44/00* (2013.01); *E21B 47/024* (2013.01)

(58) Field of Classification Search
CPC ..... E21B 47/092; E21B 47/024; E21B 44/00
See application file for complete search history.

(56) References Cited

U.S. PATENT DOCUMENTS

| | | | | |
|---|---|---|---|---|
| 5,864,058 | A | 1/1999 | Chen | |
| 6,467,341 | B1 | 10/2002 | Boucher et al. | |
| 6,719,069 | B2 | 4/2004 | Alft et al. | |
| 6,895,678 | B2 * | 5/2005 | Ash | G01V 1/52 33/313 |
| 9,062,531 | B2 | 6/2015 | Jones | |
| 9,410,377 | B2 | 8/2016 | Jain et al. | |
| 9,483,607 | B2 | 11/2016 | Sugiura | |
| 9,567,844 | B2 | 2/2017 | Mauldin et al. | |

(Continued)

FOREIGN PATENT DOCUMENTS

EP 1184539 2/2002

OTHER PUBLICATIONS

ISRWO International Search Report and Written Opinion for PCT/US2018/029690 dated Dec. 3, 2018.

*Primary Examiner* — Dany E Akakpo
(74) *Attorney, Agent, or Firm* — Thomas Rooney; C. Tumey Law Group PLLC

(57) ABSTRACT

This disclosure may generally relate to systems and methods systems and methods for determining drill bit position while drilling. A bit-position-while-drilling system may include: a drill bit; a gyroscope unit coupled to the drill bit to measure angular velocity about three axes, wherein the gyroscope unit is coupled to the drill bit in a known relationship to the drill bit; and an information handling system operable to receive gyroscope measurements from gyroscope unit and determine position of the drill bit in a borehole based at least partially on the gyroscope measurements.

18 Claims, 8 Drawing Sheets

(56) References Cited

U.S. PATENT DOCUMENTS

| | | | | |
|---|---|---|---|---|
| 2003/0111268 | A1* | 6/2003 | Alft | E21B 21/08 175/73 |
| 2007/0114068 | A1* | 5/2007 | Hall | E21B 7/064 175/73 |
| 2013/0248247 | A1 | 9/2013 | Sugiura | |
| 2016/0123137 | A1 | 5/2016 | Liu et al. | |

* cited by examiner

DRILL BIT POSITION MEASUREMENT

BACKGROUND

Wells may be drilled into subterranean formations to recover natural deposits of hydrocarbons and other desirable materials trapped in geological formations in the Earth's crust. Wells may be drilled by rotating a drill bit which may be located on a bottom hole assembly at a distal end of a drill string. While it may be desired for the drill bit to remain centered in the borehole, the drill bit often may become off-centered in the borehole. In addition, instead of being parallel to the longitudinal axis of the borehole, the drill bit is often angled in the borehole. As a result, the borehole is often irregular in shape with a size that can vary with depth. Even though these irregularities may be small, they may still be important when completing a well.

To determine the shape and size of the borehole, a logging tool may be used to provide a measurement of the borehole along its depth. A wide variety of different logging tools may be used, including caliper tools that can measure the shape and size mechanically. For example, the caliper tool may include articulating arms that push against the borehole walls, moving in and out as the caliper tool is withdrawn from the borehole. A potentiometer may be used to convert such movement into an electrical signal. Additional logging tools may measure the shape and size ultrasonically using acoustic signals. While such logging tools may be used to provide the caliper log with the borehole measurements as a function of depth, these tools are typically not used while drilling as accurate measurements may be difficult to achieve while drilling. However, measuring the shape and size of the borehole while drilling may be beneficial. If the driller has this information in real time, they would be able to make corrections immediately. Also, by knowing the shape of the hole at the instant of drilling, it may be possible to distinguish borehole shape due to the drill bit from a change in hole shape due to washouts.

BRIEF DESCRIPTION OF THE DRAWINGS

These drawings illustrate certain aspects of some examples of the present disclosure, and should not be used to limit or define the disclosure.

DETAILED DESCRIPTION

This disclosure may generally relate to well operations. More particularly, embodiments may relate to systems and methods for providing drill bit position while drilling. Systems and method may include a gyroscope to measure angular velocity from which position of the drill bit as a function of time may be determined. With the position of the drill bit as a function of time known, additional information may also be determined, such as the shape of the borehole around the drill bit. By combining this information with depth information, a caliper log may be generated showing the shape of the borehole throughout drilling. Measurements from one or more additional sensors, such as accelerometers, magnetometers, and strain gauges, may be used to improve the accuracy of the gyroscope measurements.

Figure 1:
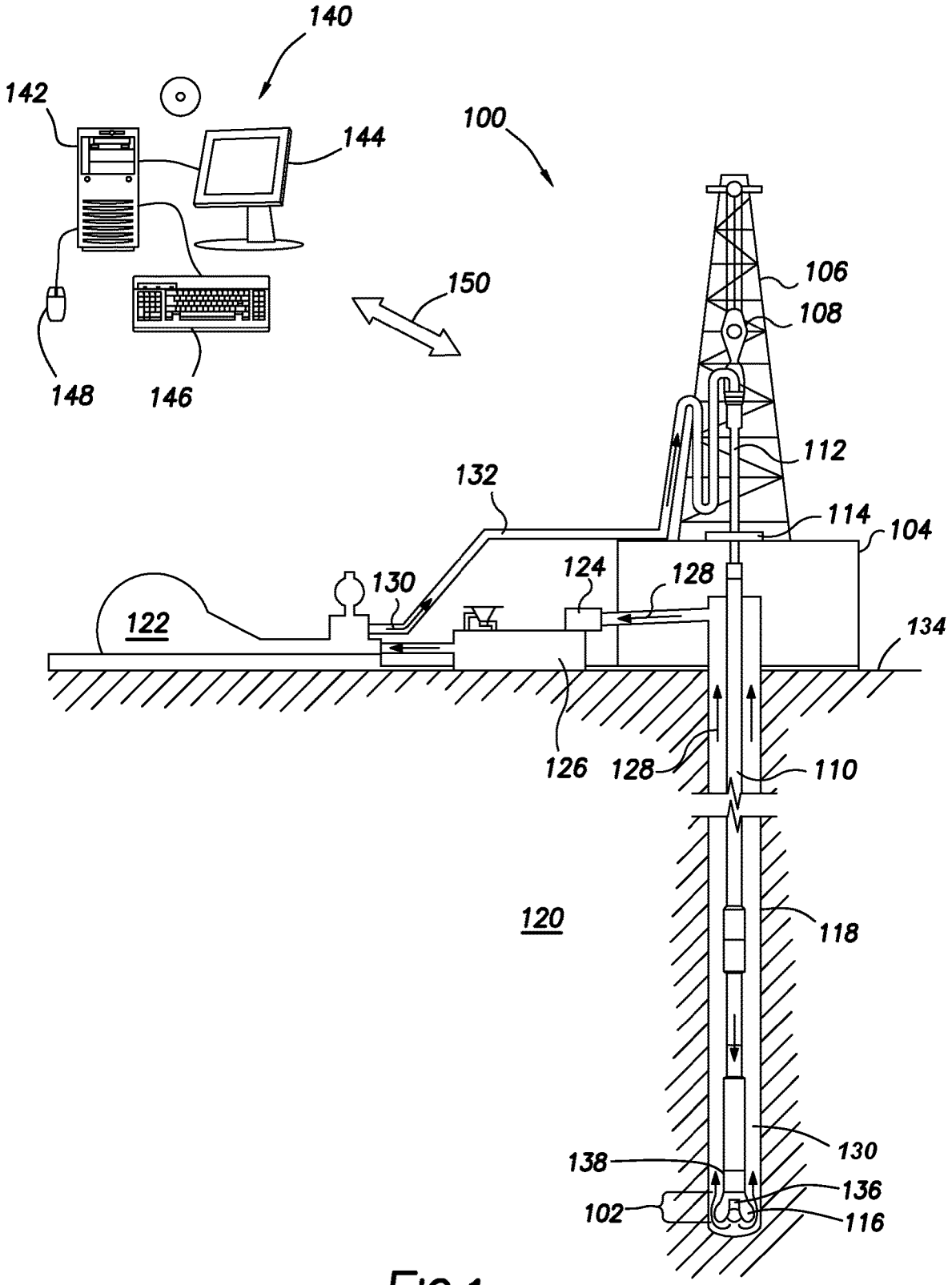
FIG. 1 illustrates an example embodiment of a drilling system.

FIG. 1 illustrates a drilling system 100 that may include a bit-position-while-drilling system 102. As will be discussed in more detail below, bit-position-while-drilling system 102 may provide bit position while drilling. With the bit position, caliper measurements may also be determined, including measurements of the shape of the borehole, such as diameter. It should be noted that while FIG. 1 generally depicts drilling system 100 in the form of a land-based system, those skilled in the art will readily recognize that the principles described herein are equally applicable to subsea drilling operations that employ floating or sea-based platforms and rigs, without departing from the scope of the disclosure.

Drilling system 100 may include a drilling platform 104 that supports a derrick 106 having a traveling block 108 for raising and lowering a drill string 110. A kelly 112 may support drill string 110 as drill string 110 may be lowered through a rotary table 114. Bit-position-while-drilling system 102 may include a drill bit 116 attached to the distal end of drill string 110 and may be driven either by a downhole motor (not shown) and/or via rotation of drill string 110. Without limitation, drill bit 116 may include any suitable type of drill bit 116, including, but not limited to, roller cone bits, PDC bits, natural diamond bits, any hole openers, reamers, coring bits, and the like. As drill bit 116 rotates, drill bit 116 may create a borehole 118 that penetrates various subterranean formations 120.

Drilling system 100 may further include a mud pump 122, one or more solids control systems 124, and a retention pit 126. Mud pump 122 representatively may include any conduits, pipelines, trucks, tubulars, and/or pipes used to fluidically convey drilling fluid 128 downhole, any pumps, compressors, or motors (e.g., topside or downhole) used to drive the drilling fluid 128 into motion, any valves or related joints used to regulate the pressure or flow rate of drilling fluid 128, any sensors (e.g., pressure, temperature, flow rate, etc.), gauges, and/or combinations thereof, and the like.

Mud pump 122 may circulate drilling fluid 128 through a feed conduit 175 and to kelly 112, which may convey drilling fluid 128 downhole through the interior of drill string 110 and through one or more orifices (not shown) in drill bit 116. Drilling fluid 128 may then be circulated back to surface 134 via a borehole annulus 130 defined between drill string 110 and the walls of borehole 118. At surface 134, the recirculated or spent drilling fluid 128 may exit borehole annulus 130 and may be conveyed to one or more solids control system 124 via an interconnecting flow line 132. One or more solids control systems 124 may include, but are not limited to, one or more of a shaker (e.g., shale shaker), a centrifuge, a hydrocyclone, a separator (including magnetic and electrical separators), a desilter, a desander, a separator, a filter (e.g., diatomaceous earth filters), a heat exchanger, and/or any fluid reclamation equipment. The one or more solids control systems 124 may further include one or more sensors, gauges, pumps, compressors, and the like used to store, monitor, regulate, and/or recondition the drilling fluid 128.

After passing through the one or more solids control systems 124, drilling fluid 128 may be deposited into a retention pit 126 (e.g., a mud pit). While illustrated as being arranged at the outlet of borehole 118 via borehole annulus 130, those skilled in the art will readily appreciate that the one or more solids controls system 124 may be arranged at any other location in drilling system 100 to facilitate its proper function, without departing from the scope of the disclosure. While FIG. 1 shows only a single retention pit 126, there could be more than one retention pit 126, such as multiple retention pits 126 in series. Moreover, retention pit 126 may be representative of one or more fluid storage facilities and/or units where the drilling fluid additives may be stored, reconditioned, and/or regulated until added to drilling fluid 128.

Bit-position-while-drilling system 102 may include drill bit 116 and a gyroscope unit 136. Gyroscope unit 136 may be coupled to drill bit 116. In particular, gyroscope unit 136 may be fixedly coupled to drill bit 116 so that there may be a known relationship between the location of gyroscope unit 136 and the geometry of drill bit 116. Gyroscope unit 136 may be a three-axis gyroscope to provide measurements of angular velocity about the x-, y-, and z-axes (e.g. x, y, and z axes shown on FIG. 2) of gyroscope unit 136. The x-, y-, and z-axes of gyroscope unit 136 may (or may not) correspond with the x-, y-, and z-axes of drill bit 116. In addition, bit-position-while-drilling system 102 may include additional sensors including, but not limited to, strain gauges (e.g., strain gauge unit 404 on FIG. 4), vibration sensors (e.g., vibration sensor unit 402 on FIG. 4), and magnetometers (e.g., magnetometer unit 400 on FIG. 4). The gyroscope (or other sensor) measurements may be stored in a conventional downhole recorder (not shown), which can be accessed at surface 134 when bit-position-while-drilling system 102 is retrieved.

In addition, bit-position-while-drilling system 102 may further include communication module 138. Communication module 138 may be configured to transmit information to surface 134. While not shown, communication module 138 may also transmit information to other portions of the bottom hole assembly (e.g., rotary steerable system) or a data collection system further up the bottomhole assembly. For example, communication module 138 may transmit gyroscope measurements and/or additional sensor measurements from bit-position-while-drilling system 102. In addition, where processing occurs at least partially downhole, communication module 138 may transmit the processed (and/or partially processed measurements) to surface 134. Information may be transmitted from communication module 138 to surface 134 using any suitable unidirectional or bidirectional wired or wireless telemetry system, including, but not limited to, an electrical conductor, a fiber optic cable, acoustic telemetry, electromagnetic telemetry, pressure pulse telemetry, combinations thereof or the like. Communication module 138 may include a variety of different devices to facilitate communication to surface, including, but not limited to, a powerline transceiver, a mud pulse valve, an optical transceiver, a piezoelectric actuator, a solenoid, a toroid, or an RF transceiver, among others.

The gyroscope measurements may be processed to bit position and caliper information, including, but not limited to, borehole 118 diameter and/or borehole 118 shape. It should be understood that there may be multiple diameters and corresponding angles at each depth in the well. For example, the caliper information may include a specific diameter when measurement over a certain angle at a depth. Measurements from the additional sensors may be used with the gyroscope measurements in determining bit position and caliper information for borehole 118. Bit-position-while-drilling system 102 may further include information handling system 140 configured for processing the measurements from gyroscope unit 136 and/or the additional sensors (where present). As illustrated, information handling system 140 may be disposed at surface 134. In examples, information handling system 140 may be disposed downhole. Any suitable technique may be used for transmitting signals from communication module 138 to information handling system 140. A communication link 150 (which may be wired, wireless, or combinations thereof, for example) may be provided that may transmit data from communication module 138 to information handling system 140. Without limitation, information handling system 140 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 140 may be a personal computer, a network storage device, or any other suitable device and may vary in size, shape, performance, functionality, and price. Information handling system 140 may include random access memory (RAM), one or more processing resources (e.g. a microprocessor) such as a central processing unit 142 (CPU) or hardware or software control logic, ROM, and/or other types of nonvolatile memory. Additional components of information handling system 140 may include one or more of a monitor 144, an input device 146 (e.g., keyboard, mouse, etc.) as well as computer media 148 (e.g., optical disks, magnetic disks) that may store code representative of the methods described herein. Information handling system 140 may also include one or more buses (not shown) operable to transmit communications between the various hardware components.

Figure 2:
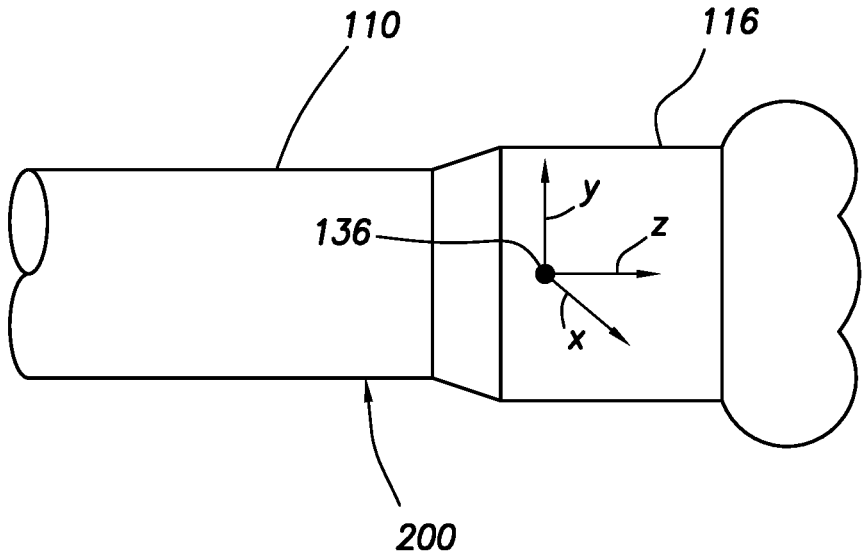
FIG. 2 illustrates an example embodiment of a drill bit installed on drill string with a gyroscope unit.

FIG. 2 illustrates installation of drill bit 116 on drill string 110 in more detail. As illustrated, drill bit 116 may be coupled to distal end 200 of drill string 110. Gyroscope unit 136 may be coupled to drill bit 116. Gyroscope unit 136 may be a three-axis gyroscope to provide measurements of angular velocity about the x-, y-, and z-axes of gyroscope unit 136 illustrated on FIG. 2 as x, y, and z. While not shown, gyroscope unit 136 may alternatively be implemented as three separate single axis gyroscopes. Where separate gyroscopes are used, the gyroscopes may be deployed at the same or different locations in the drill bit 116 with each gyroscope aligned in a radial direction. As previously described, gyroscope unit 136 may be fixed with respect to drill bit 116 so that determining position of gyroscope unit 136 will give position of drill bit 116.

Figure 3:
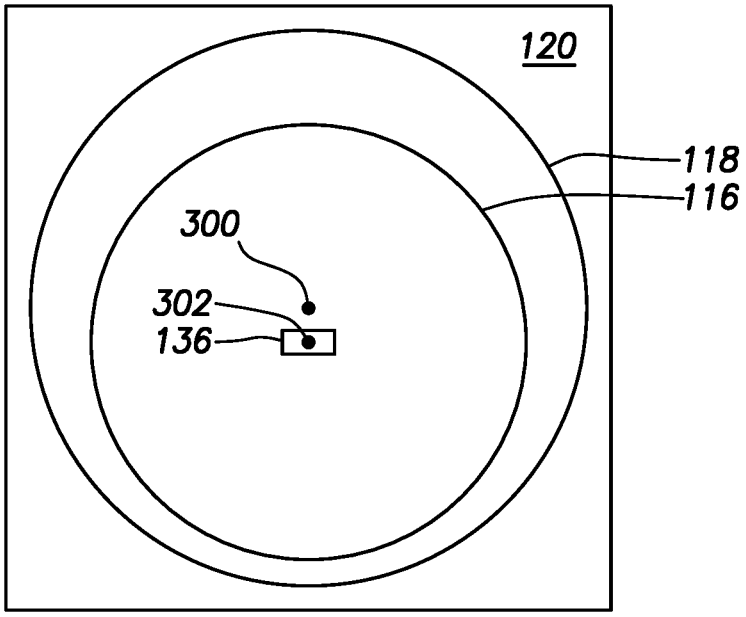
FIG. 3 illustrates a schematic cross-section view of a drill bit in a borehole.

FIG. 3 is a schematic cross-sectional view illustrating drill bit 116 in borehole 118. As previously described, drill bit 116 may be rotated to extend borehole 118 into subterranean formation 120. As illustrated, borehole 118 may have a circular cross-section with a borehole centerpoint 300. While borehole 118 is shown having a circular cross-section, it should be understood that borehole 118 may have other shapes, including irregular cross-sections. As drill bit 116 rotates, the path it travels may not be perfectly straight. In other words, drill bit 116 may not always be centered in borehole 118. As illustrated, bit centerpoint 302 may be offset from borehole centerpoint 300, indicating that borehole 118 may not be centered in borehole 118. As previously described, gyroscope unit 136 may be used to obtain bit position and caliper information for borehole 118. Gyroscope unit 136 may measure angular velocity from which position of drill bit 116 as a function of time may be determined. With the position of the drill bit 116 as a function of time known, the shape of borehole 118 around drill bit 116 may be determined. By combining this information with depth information, a caliper log may be generated showing the shape of borehole 118 throughout drilling. The caliper log may be a physical log that can be presented as an image to an operator.

Figure 4:
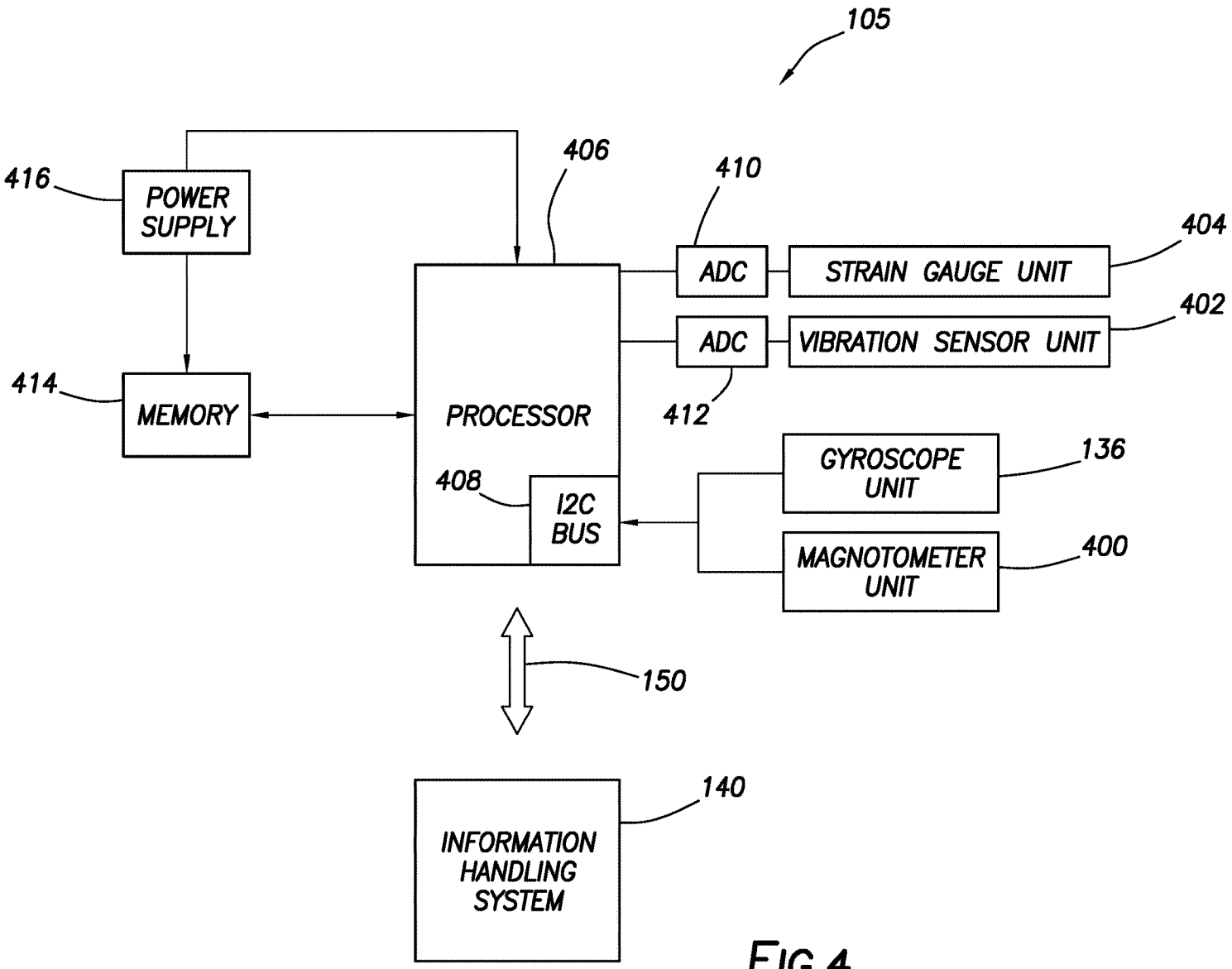
FIG. 4 illustrates a schematic diagram of an example embodiment of a bit-position-while-drilling system.

FIG. 4 is a schematic diagram of an illustrative bit-position-while-drilling system 102. Bit-position-while-drilling system 102 may include gyroscope unit 136 and one or more additional sensors, including, but not limited to, magnetometer unit 400, vibration sensor unit 402, and/or strain gauge unit 404. Gyroscope unit 136 may be coupled to processor 406 by way of a communication link, such as an I2C (Inter-IC) bus 408. Magnetometer unit 400 may include any suitable magnetometer, including, but not limited to, a three-axis magnetometer. Magnetometer unit 400 may take magnetic field measurements, including measurements of vector components and/or magnitude. Magnetometer unit 400 may be coupled to processor 406 by way of a communication link, such as I2C (Inter-IC) bus 408. Vibration sensor unit 402 may include any suitable sensor for measuring vibration, including an accelerometer. Vibration sensor unit 402 may provide measurements of linear velocity and/or acceleration, among others. Vibration sensor unit 402 may be coupled to processor 406 by way of first analog-to-digital converter 410. Strain gauge unit 404 may include any suitable sensor for measuring strain on drill bit 116 (e.g., shown on FIGS. 1 and 2). Strain gauge unit 404 may be coupled to processor 406 by way of second analog-to-digital converter 412.

Processor 406 may include any suitable processor or microprocessor, including, but not limited to, a digital signal processor. Processor 406 may receive measurements from gyroscope unit 136, as well as magnetometer unit 400, vibration sensor unit 402, and strain gauge unit 404, where available. Among other functions, processor 406 may collect data from the different sensors and store it, or apply any set of mathematical equations to determine motion of the device or statistical significance of the data. Processor 406 may be coupled to memory 414. The measurements received by processor 406 may be stored in memory 414. Memory 414 may include any suitable type of memory, including, but not limited to RAM memory and flash memory. Bit-position-while-drilling system 102 may further include power supply 416. Power supply 416 may supply power to components of bit-position-while-drilling system 102, including memory 414 and processor 406. Any suitable power supply 416 may be used, including, but not limited to, batteries, capacitors, turbines and wired or wireless power delivered from higher up in the bottom hole assembly.

Measurements from the sensors, including gyroscope unit 136, magnetometer unit 400, vibration sensor unit 402, and/or strain gauge unit 404 may be transmitted to information handling system 140. The measurements may be transmitted from bit-position-while-drilling system 102 in borehole 118 (e.g., shown on FIG. 1) or, alternatively, may be stored downhole with transmission to information handling system 140 after recovery of bit-position-while-drilling system 102 from borehole 118. Communication link 150, which may be wired or wireless, may transmit information from processor 406 to information handling system 140. Information handling system 140 may process the measurements to determine position of drill bit 116 (e.g., shown on FIG. 1) as a function of time. From this position, information handling system 140 may determine shape of the borehole 118 around drill bit 116, which, when combined with depth information, may be used to generate a caliper log. The caliper log may include information relating to size and shape of borehole 118, such as borehole diameter. The caliper log may be stored on information handling system 140 and may also be displayed to an operator as a physical log or in graphical form.

Figure 5:
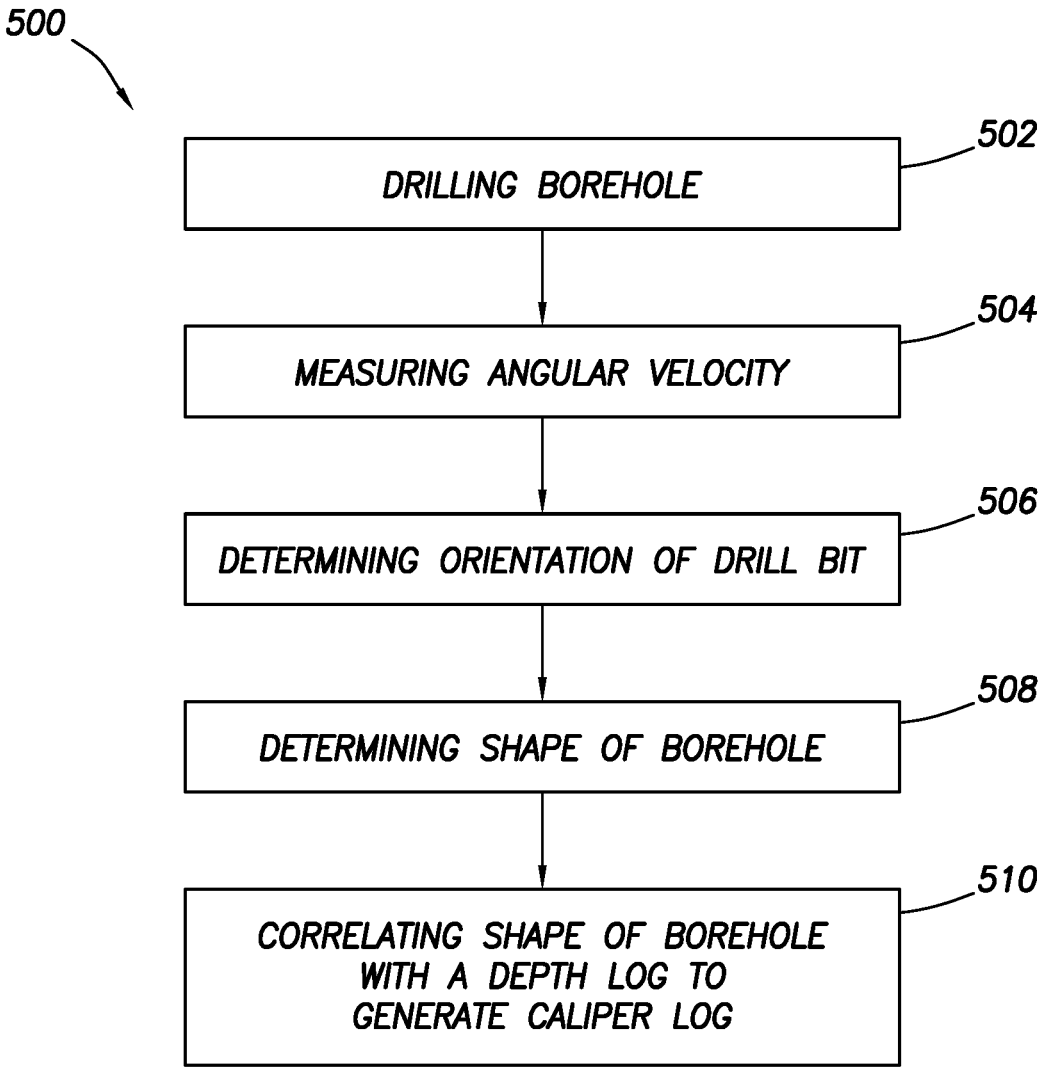
FIG. 5 is a flow diagram of an example embodiment of a method for making caliper measurements while drilling.

FIG. 5 is a flow diagram of an example method 500 that may be implemented using the techniques disclosed herein in determining caliper information. In block 502, the method may include drilling borehole 118 (e.g., shown on FIG. 1). As shown on FIG. 1, drill bit 116 may be disposed in borehole 118 so as drill bit 116 rotates in drilling borehole 118, drill bit 116 advances in borehole 118. In block 504, method 500 may include obtaining gyroscope measurements. The gyroscope measurements may be obtained while drilling, for example, while rotating drill bit 116 to advance drill bit 116. As previously described, gyroscope measurements may be obtained using gyroscope unit 136 (e.g., shown on FIG. 1) coupled to drill bit 116. Gyroscope measurements may include measurements of angular velocity about the x-, y-, and z-axes of gyroscope unit 136 (e.g., x, y, and z axes on FIG. 2).

In block 506, method 500 may include determining position of drill bit 116 (e.g., shown on FIG. 1) as a function of time using at least the gyroscope measurements. By way of example, the gyroscope measurements may be integrated to determine position of drill bit 116 as a function of time. As the relationship between the drill bit 116 and gyroscope unit 136 is known, the gyroscope measurement may provide position of drill bit 116. The additional sensor measurements may be used with the gyroscope measurements in determining position of drill bit 116. These additional measurements may allow more accurate determination of position, for example, as they may be useful in correcting problems, such as gyroscope drift. The additional sensor measurements may include, but are not limited to, measurements from magnetometer unit 400, vibration sensor unit 402, and/or strain gauge unit 404 (e.g., shown on FIG. 4). Any of a variety of different techniques may be used to incorporate these additional sensor measurements with the gyroscope measurements, including, but not limited to, sensor fusion, which may be used to generate a model that best fits all measured data, which may be more accurate than any single measurement.

In block 508, method 500 may include determining shape of borehole 118 (e.g., FIG. 1) around drill bit 116 (e.g., FIG. 1). As bit geometry may be known and position of drill bit 116 was determined in block 506 as a function of time, the shape of borehole 118 around drill bit 116 as a function of time may also be readily determined. In other words, the shape of borehole 118 may be considered the shape of drill bit 116 over time. In block 510, method 500 may include generating a caliper log using the shape information. By using depth information corresponding with time, the caliper log may be created, for example, showing shape of borehole 118 with depth. Caliper log may include a graphical representation of shape of borehole 118 or diameter of borehole 118 with depth, among other information.

Figure 6:
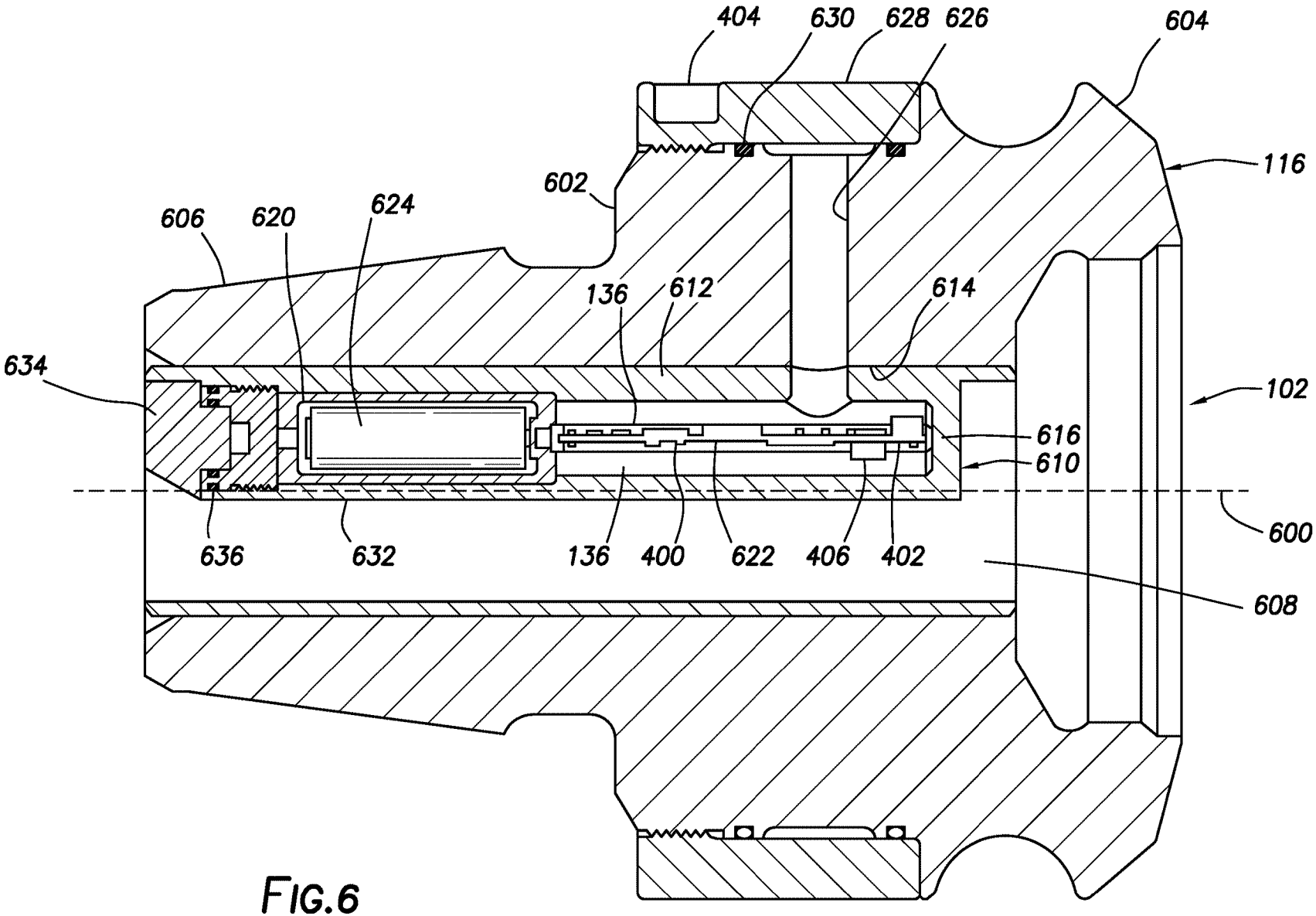
FIG. 6 illustrates a cross-sectional view taken along the longitudinal axis of an example embodiment of a drill bit with a bit-position-while drilling system.

FIG. 6 illustrates a cross-sectional view of an example embodiment of bit-position-while-drilling system 102 taken along longitudinal axis 600 of drill bit 116. Any suitable type of drill bit 116 may be used with bit-position-while-drilling system, including, but not limited to, roller cone bits, PDC bits, natural diamond bits, any hole openers, reamers, coring bits, and the like. Drill bit 116 may include a bit body 602, cutting elements 604, and shank 606. Shank 606 may be the portion of drill bit 105 secured to drill string 110 (e.g., FIGS. 1 and 2) by which drill bit 116 may be held and drive. Bit body 602 may be the portion of drill bit 105 that extends from shank 606 to cutting elements 604. Cutting elements 604 may be disposed on bit body 602 and engage rock. Cutting elements 604 may have any suitable shape, including, but not limited to, tooth-shape, cone-shaped, or otherwise formed. Through bore 608 may extend through bit body 602 and shank 606. As illustrated, through bore 608 may extend along longitudinal axis 600, for example, to provide a pathway for fluid travel (e.g. drilling fluid) through drill bit 105.

Sensor subassembly 610 may be disposed in through bore 608. Sensor subassembly 610 may include insert 612. Insert 612 may be secured to inner wall 614 of through bore 608. Any suitable technique may be used for securing insert 612 to inner wall 614, including, but not limited to, mechanical fasteners and welding, among others. While insert 612 may have any suitable shape, in some implementations, insert 612 may be cylindrical in form. Sensor subassembly 610 may include housing 616. Housing 616 may also include sidewalls 632 and end cap 634 to at least partially define interior of housing 616. Seals 636 may be used to provide that housing 616 may be fluid tight. Housing 616 may include one or more compartments, including, but not limited to, sensor compartment 618 and battery compartment 620. Circuit board 622 may be disposed in sensor compartment 618. Any suitable type of circuit board 622 may be used, including, but not limited to, printed circuit boards, which may be rigid or flexible. Circuit board 622 may include electronics for implementation of caliper measurements. For example, circuit board 622 may include gyroscope unit 136, magnetometer unit 400, and/or vibration sensor unit 402. Circuit board 622 may also include processor 406. Battery 624 may be disposed in battery compartment 620. Any suitable type of battery 624 may be used, including, but not limited to, lithium thionyl chloride batteries, lithium manganese dioxide batteries, lithium-ion batteries, alkaline batteries, nickel-cadmium batteries, and nickel-metal hydride batteries, among others. As previously described, bit-position-while-drilling system 102 may also include strain gauge unit 404. As illustrated, strain gauge unit 404 may be disposed on bit body 602 to determine strain experienced by bit body 602 during drilling. Channel 626 may be provided in bit body 602 for wires from strain gauge unit 404 to couple with circuit board 622. Cover 628 may be disposed on channel 626, for example, to hold downhole pressure and prevent fluid from entering through bore 608 while seals 630 may provide additional sealing to prevent fluid ingress.

Figure 7:
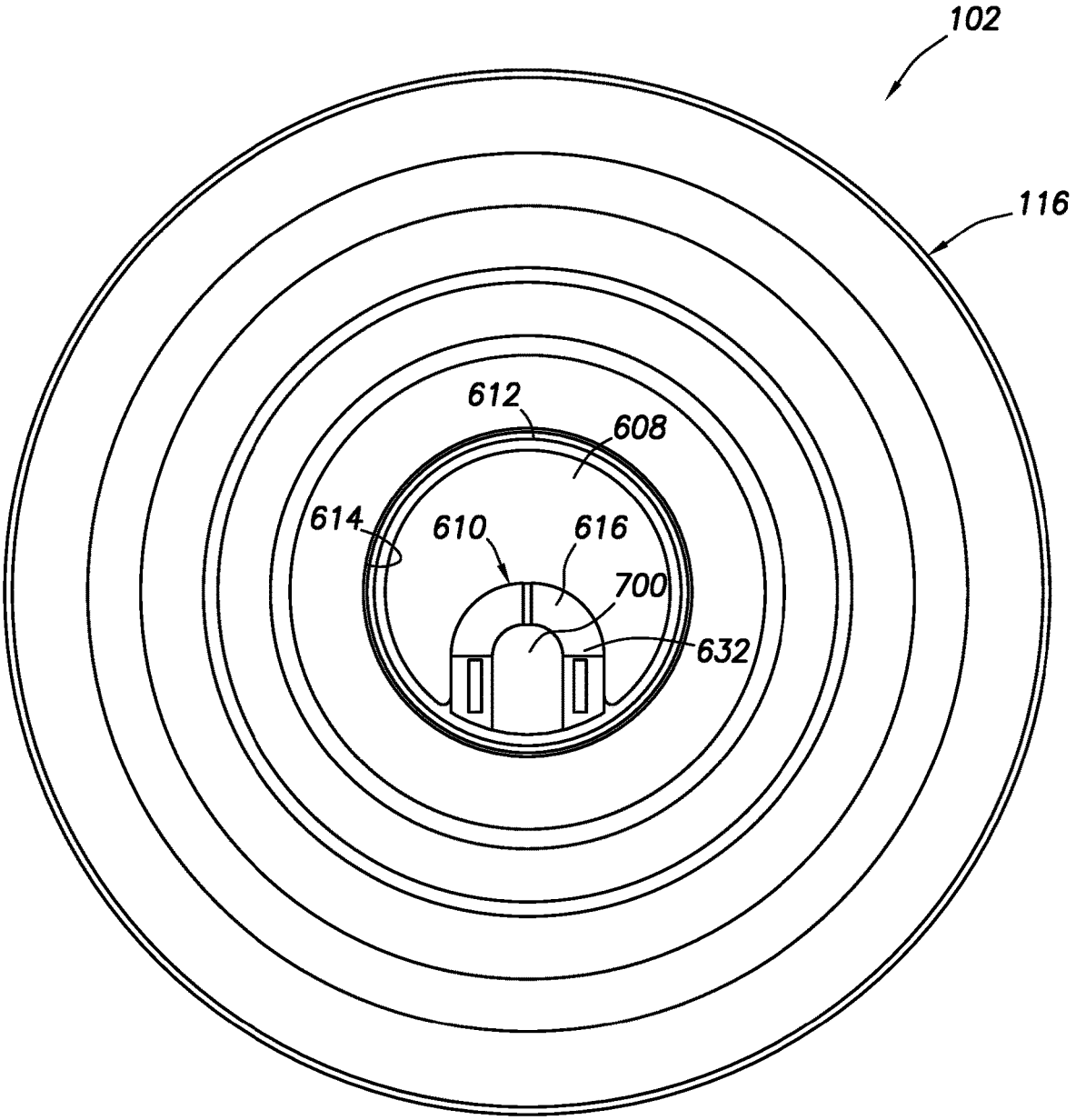
FIG. 7 illustrates a cross-sectional view taken along the transverse axis of an example embodiment of a drill bit with a bit-position-while drilling system.

FIG. 7 illustrates a cross-sectional view of the example embodiment of bit-position-while-drilling system 102 of FIG. 6 taken along the transverse axis of drill bit 116. As illustrated, sensor subassembly 610 may be disposed in through bore 608. Sensor subassembly 610 may include insert 612 and housing 616. As illustrated, insert 612 may be secured to inner wall 614 of through bore 608. Housing 616 may include sidewalls 632 and interior 700. Housing 616 and insert 612 may be unitary, in some examples, or housing 616 and insert 612 may be separate pieces. Where separate, housing 616 may be secured to insert 612 using any suitable technique, including, but not limited to, mechanical fasteners and welds. As illustrated, housing 616 may extend from insert 612 into through bore 608. It should be understood that the embodiment of bit-position-while-drilling system 102 shown on FIGS. 6 and 7 are merely one illustrative example and that bit-position-while-drilling system 102 may be modified or otherwise formed as desired for obtaining caliper measurements in accordance with present techniques.

Figure 8:
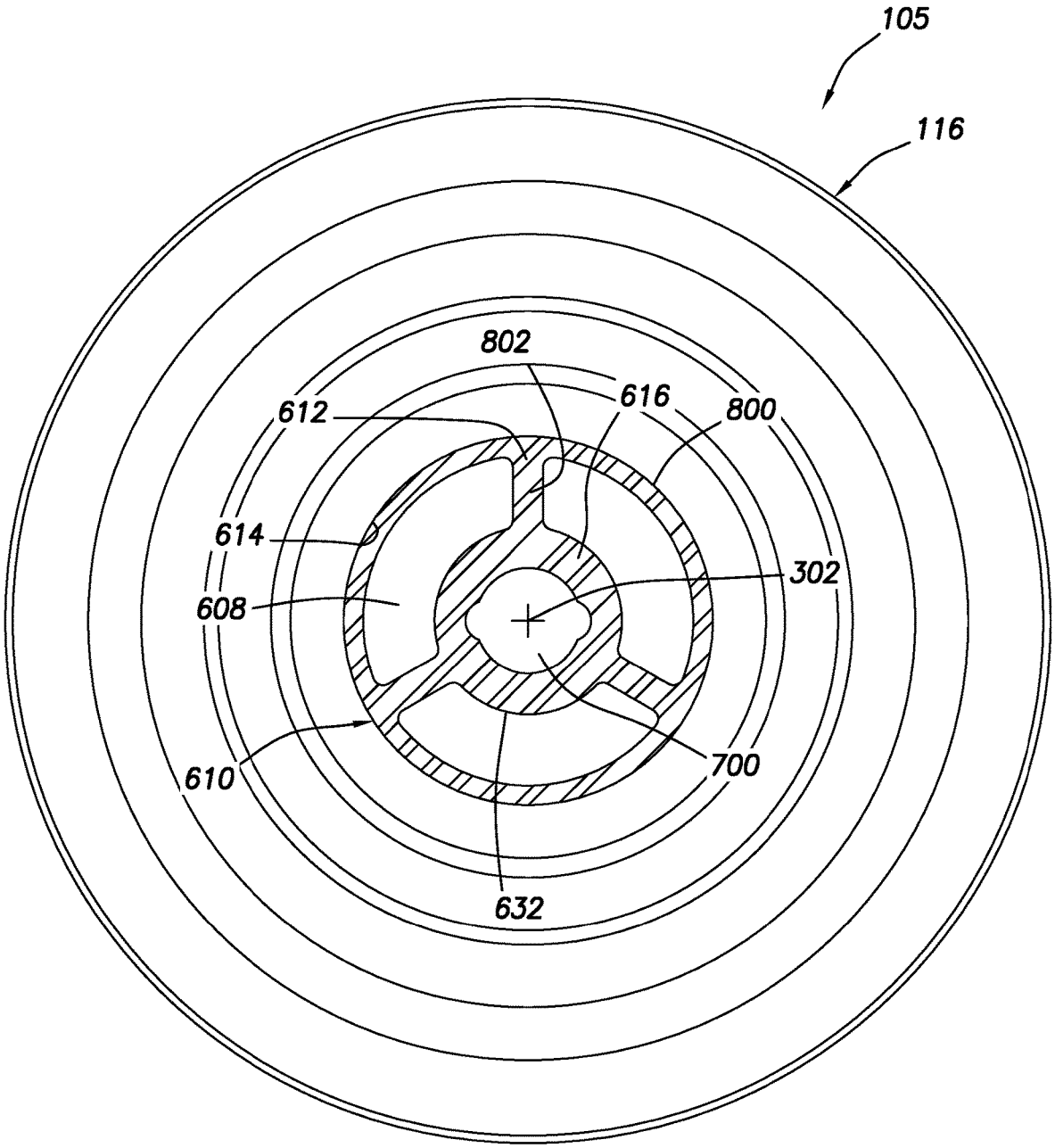
FIG. 8 illustrates a cross-sectional view taken along the longitudinal axis of another example embodiment of a drill bit with a bit-position-while drilling system.

FIG. 8 illustrates a cross-sectional view of another example embodiment of bit-position-while-drilling system 102 taken along the transverse axis of drill bit 116. As illustrated, sensor subassembly 610 may be disposed in through bore 608. Sensor subassembly 610 may include insert 612 and housing 616. As illustrated, insert 612 may be secured to inner wall 614 of through bore 608. Housing 616 may include sidewalls 632 and interior 700. Housing 616 and insert 612 may be unitary, in some examples, or housing 616 and insert 612 may be separate pieces. Where separate, housing 616 may be secured to insert 612 using any suitable technique, including, but not limited to, mechanical fasteners and welds. As illustrated, insert 612 may include body portion 800 and struts 802. Body portion 800 may be cylindrically shaped, in some examples. Body portion 800 may engage inner wall 614 of through bore 608. Struts 802 may extend from body portion 800 into through bore 608. Struts 802 may support and position housing 616 in through bore 608. As illustrated, struts 802 may be arranged to centrally position housing 616 in through bore 608. By way of example, housing 616 may be disposed around bit centerpoint 302.

Figure 9:
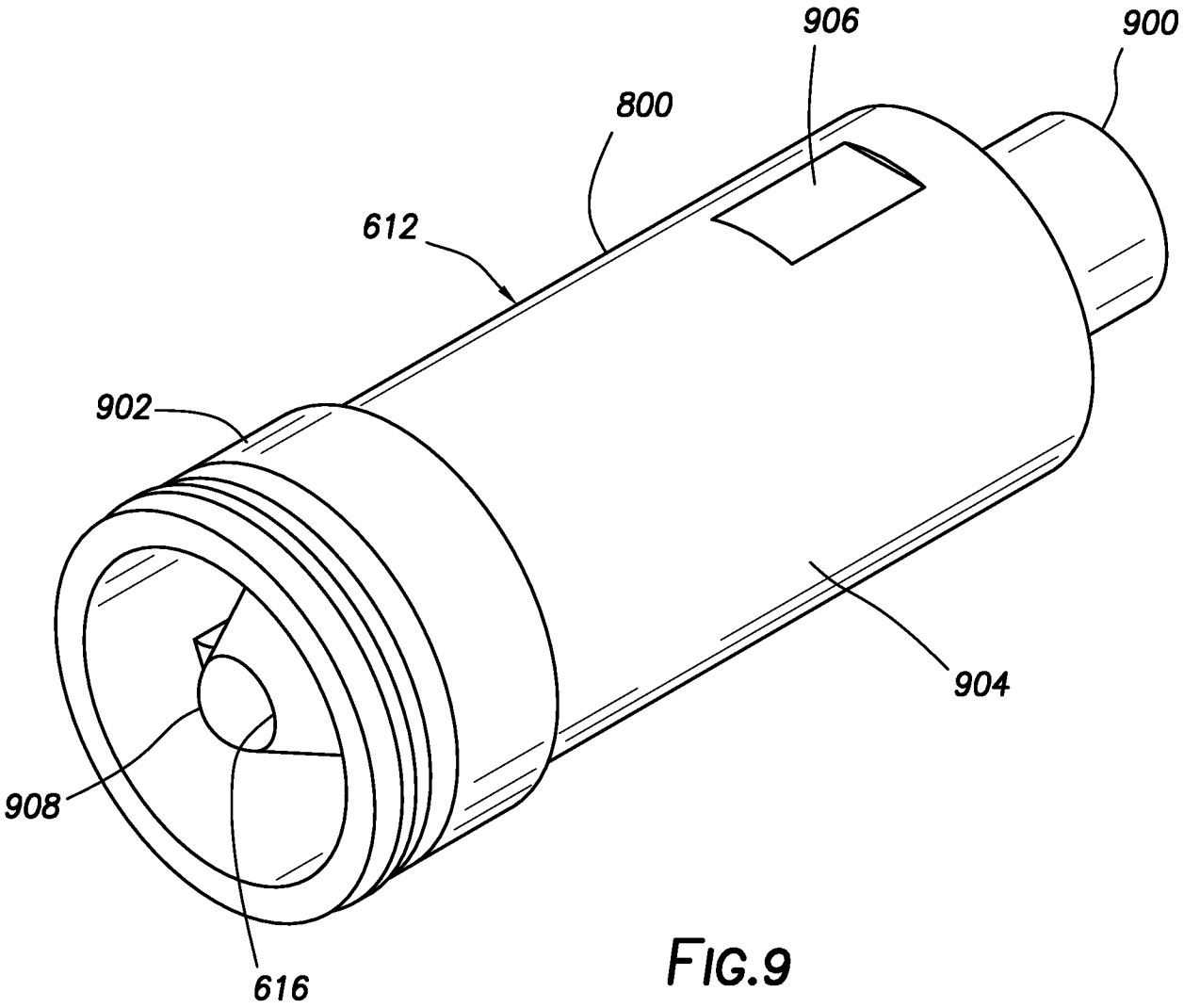
FIG. 9 illustrates a perspective view of an insert for use in a bit-position-while drilling system.

FIG. 9 illustrate an illustrate example of insert 612 shown on FIG. 8. As illustrated inert 612 may include a body portion 800 that is cylindrical in form. Body portion 800 may include a first end portion 900 with a reduced diameter at one end and a second end portion 902 with an enlarged diameter at the opposite end. The diameter of first end portion 900 may be considered reduced with respect to central portion 904 of body portion 800. Central portion 904 may include recess 906, for example, to provide a gripping surface when handling insert 612. The diameter of second end portion 902 may be considered enlarged with respect to central portion of body portion 800. Housing 616 is shown disposed in insert 612. As illustrated, housing 616 may include a nose portion 908, for example, to facilitate fluid flow around housing 616. As previously described, insert 612 may support and position housing 616 in through bore 608 (e.g., shown on FIG. 8)

The systems and methods for providing caliper measurements while drilling may include any of the various features of the systems and methods disclosed herein, including one or more of the following statements.

[Claims Bank to be Added when Finalized.]

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A bit-position-while-drilling system comprising:
- a drill bit;
- a gyroscope unit coupled to the drill bit in a known positional relationship to measure angular velocity about at least two axes;
- a sensor subassembly disposed in a bore of the drill bit, wherein the sensor subassembly comprises an insert and a housing, wherein the insert is coupled to a wall of the bore, wherein the housing is coupled to the insert and contains the gyroscope unit; and
- an information handling system operable to receive the angular velocity from the gyroscope unit and determine an orientation of the drill bit in a borehole over time based at least partially on integration of the angular velocity.

2. The system of claim 1, further comprising an accelerometer unit coupled to the drill bit to obtain acceleration measurements, wherein the information handling system receives the acceleration measurements from the accelerometer unit and corrects gyroscope drift with the acceleration measurements.

3. The system of claim 1, further comprising a magnetometer unit coupled to the drill bit to obtain magnetic field measurements, wherein the information handling system uses the magnetic field measurements in combination with measurements from the gyroscope unit to determine the orientation of the drill bit in the borehole over time.

4. The system of claim 1, wherein the information handling system is further operable to determine a shape of the borehole over time from the orientation of the drill bit and correlate the shape of the borehole over time to a depth log to generate a caliper log.

5. The system of claim 1, wherein the information handling system is located at a surface of the borehole.

6. The system of claim 1, wherein the housing comprises:
- a sensor compartment;
- a circuit board disposed in the sensor compartment, wherein the gyroscope unit is disposed on the circuit board;
- a battery compartment;
- a battery disposed in the battery compartment, and
- a processor disposed on the circuit board.

7. The system of claim 6, wherein the system further comprises an accelerometer unit disposed on the circuit board, a magnetometer unit disposed on the circuit board, and a strain gauge unit disposed on a body of the drill bit.

8. The system of claim 1, wherein the insert comprises a body portion secured to the wall of the bore and struts that extend from the body portion to support the housing in the bore.

9. The system of claim 8, wherein the struts position the housing centrally in the bore.

10. A bit-position-while-drilling system comprising:
- a drill bit comprising a shank, a bit body that extends from the shank, and cutting elements disposed on the bit body, wherein a through bore extends through the shank and the bit body;
- a sensor subassembly disposed in the through bore, wherein the sensor subassembly comprises:
  - an insert coupled to a wall of the through bore;
  - a housing coupled to the insert, wherein the housing comprises a sensor compartment and a battery compartment;
  - a circuit board disposed in the sensor compartment;
  - a battery disposed in the battery compartment;
  - a processor disposed on the circuit board;
  - a gyroscope unit disposed on the circuit board;
  - an accelerometer unit disposed on the circuit board; and
  - a magnetometer unit disposed on the circuit board; and
- an information handling system operable to receive gyroscope measurements from the gyroscope unit and measurements from the accelerometer unit and the magnetometer unit and determine an orientation of the drill bit in a borehole over time based at least partially on integration of the gyroscope measurements and the measurements from the accelerometer unit and the magnetometer unit.

11. The system of claim 10, wherein the insert comprises a body portion coupled to the wall of the through bore and struts that extend from the body portion to support the housing in the through bore.

12. The system of claim 11, wherein the struts position the housing centrally in the through bore.

13. The system of claim 10, further comprising a strain gauge unit disposed on the bit body, wherein the information handling system is further operable to receive measurements from the strain gauge unit.

14. A method for determining bit position comprising:
- drilling a borehole into one or more subterranean formations using a drill bit;
- measuring angular velocity about at least two axes over time with a gyroscope unit during the drilling the borehole, wherein the gyroscope unit is coupled to the drill bit in a known positional relationship;

determining an orientation of the drill bit in the borehole at least partially based on integration of the angular velocity; and generating a caliper log at least partially based on the orientation of the drill bit, wherein the generating the caliper log comprises determining a shape of the borehole over time from the orientation of the drill bit and correlating the shape of the borehole with a depth log to generate the caliper log.

15. The method of claim 14, further comprising measuring acceleration over time with an accelerometer coupled to the drill bit to obtain accelerometer measurements and correcting gyroscope drift using the accelerometer measurements.

16. The method of claim 14, further comprising measuring a magnetic field over time with a magnetometer unit coupled to the drill bit to obtain magnetic field measurements, wherein the step of determining the orientation uses the magnetic field measurements.

17. The method of claim 14, further comprising measuring acceleration over time with an accelerometer coupled to the drill bit to obtain accelerometer measurements, measuring a magnetic field over time with a magnetometer unit coupled to the drill bit to obtain magnetic field measurements, measuring strain on the drill bit over time with a strain gauge unit coupled to the drill bit to obtain strain gauge measurements, and applying the accelerometer measurements, the magnetic field measurements, and the strain gauge measurements with the angular velocity in a sensor fusion to obtain the orientation of the drill bit.

18. The method of claim 14, wherein the gyroscope unit is disposed in a circuit board, wherein the circuit board is disposed in a housing secured in a through bore in the drill bit.

* * * * *